United States Patent [19]

Fujii

[11] 4,257,743

[45] Mar. 24, 1981

[54] COUPLING DEVICES OF MOVING BLADES OF STEAM TURBINES

[75] Inventor: Michinobu Fujii, Hiratsuka, Japan

[73] Assignee: Tokyo Shibaura Denki Kabushiki Kaisha, Kanagawa, Japan

[21] Appl. No.: 19,590

[22] Filed: Mar. 12, 1979

[30] Foreign Application Priority Data

Mar. 24, 1978 [JP] Japan ..... 53/33837

[51] Int. Cl.[3] ..... F01D 5/22

[52] U.S. Cl. ..... 416/196 R; 416/500

[58] Field of Search ..... 416/196 R, 193 A, 500, 416/190, 191

[56] References Cited

U.S. PATENT DOCUMENTS

| | | | |
|---|---|---|---|
| 3,159,379 | 12/1964 | Auger | 416/198 A X |
| 3,719,432 | 3/1973 | Musick et al. | 416/196 |
| 3,752,599 | 8/1973 | Pace | 416/190 |
| 3,795,462 | 3/1974 | Trumpler | 416/196 |
| 3,990,813 | 11/1976 | Imai et al. | 416/196 R |
| 4,083,655 | 4/1978 | Tempere | 416/196 R |

FOREIGN PATENT DOCUMENTS

| | | | |
|---|---|---|---|
| 69842 | 12/1958 | France | 416/196 |

*Primary Examiner*—Everette A. Powell, Jr.
*Attorney, Agent, or Firm*—Stevens, Davis, Miller & Mosher

[57] ABSTRACT

A coupling device of moving blades of a steam turbine comprises a pair of projections provided on the inner and outer surfaces of the adjacent moving blades. One of the projections is provided with a hemispherical recess which loosely and slidably receives a corresponding hemispherical projection provided for the other projection when the moving blades are assembled.

1 Claim, 5 Drawing Figures

COUPLING DEVICES OF MOVING BLADES OF STEAM TURBINES

BACKGROUND OF THE INVENTION

This invention relates to a device for coupling moving blades of a steam turbine capable of effectively preventing the deformation and the vibration of the moving blades during operation.

Generally, when the moving blades of a steam turbine are rotated, they are subjected to a considerably large centrifugal force. Particularly, in recent years, there is required a steam turbine having a large capacity.

In such turbine, the length of the moving blades of the final stage becomes substantial and such long moving blades are subjected to a larger centrifugal force during the operation.

In such turbine, since the turbine blades in the final stage are constructed to be twisted longitudinally, the centrifugal force acts on the blades to deform, namely untwist, the blades. In addition, there is a problem that vibration of the turbine blades due to natural vibration and vibration due to an external force caused by steam impulse are generated when they are rotated at a high speed. Therefore, it is required to increase the efficiency for attenuating these vibrations.

Although it will be described in detail hereinafter in conjunction with the accompanying drawings, in a prior art, in order to eliminate the problems described above, the moving blades were interconnected in, for example, the following manners.

1. To fix all blades by using a wire and then weld them.

2. To provide projections on the inner and outer surfaces of the all blades and then weld the adjacent projections.

3. To connect the adjacent projections by using a coupling member.

However, these connecting methods have such problems as formation of cracks in the welded portions, a difficulty in firm welding of the projections and requirement of much time and work for assembling the coupling members.

SUMMARY OF THE INVENTION

Accordingly, an object of this invention is to provide an improved coupling device of the moving blades of a steam turbine capable of effectively preventing the deformation and the vibration of the turbine blades during the operation.

According to this invention the above object can be achieved by providing a coupling device of moving blades of a steam turbine which comprises a pair of projections provided on the inner and outer surfaces of adjacent blades. One of the projections is provided with a hemispherical projection and the other is provided with a hemispherical recess for loosely receiving the hemispherical projection when the adjacent blades are assembled.

DESCRIPTION OF THE PREFERRED EMBODIMENTS

Figure 1:
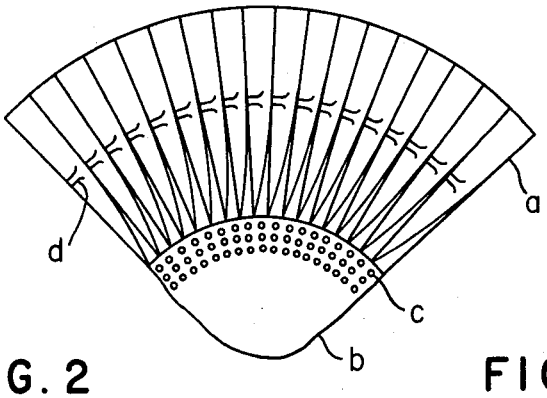
FIG. 1 PRIOR ART
FIG. 1 is a front view showing a portion of moving blades of a steam turbine attached to a turbine wheel.

To more readily understand this invention, prior arts are firstly described hereunder in conjunction with FIG. 1 through FIG. 4. FIG. 1 shows a portion of moving blades a having one ends secured to a blade wheel b by pins c, respectively, and the blades extend radially outwardly from the blade wheel b. Coupling members d interconnect adjacent turbine blades a to limit the vibration of the blades during operation.

Figure 2:
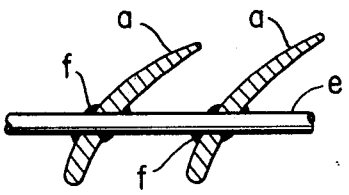
FIG. 2 PRIOR ART
FIG. 2 through FIG. 4 show examples of turbine blades coupling methods of the prior art.
Figure 3:
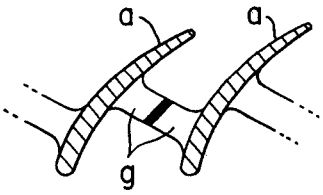
FIG. 3 PRIOR ART
Figure 4:
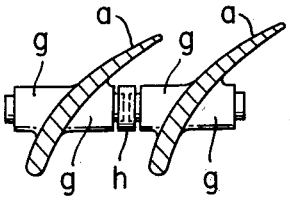
FIG. 4 PRIOR ART

FIG. 2 through FIG. 4 show some prior art examples of the method of interconnecting the turbine blades a. In FIG. 2, all blades a are provided with holes at the same positions, to pass a wire or fine rod e therethrough and the wire is then welded to the blades a. In FIG. 3, adjacent blades a are provided with projections g on the inner and outer surfaces which are welded together, and in FIG. 4, the projections of the adjacent blades a are movably interconnected by using coupling member h.

However, these turbine blade connecting methods involve such problems as formation of cracks at the welded portions due to the vibration of the blades, a difficulty for welding the projections positioned between the blades, and attachment of an additional coupling member.

These problems can be solved by the coupling device of this invention which will be described hereunder in detail in conjunction with FIG. 5.

Figure 5:
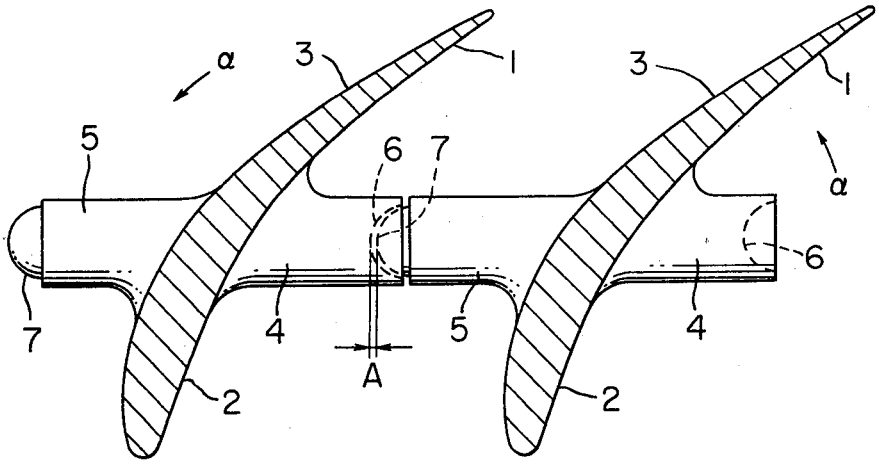
FIG. 5 shows adjacent two turbine blades connected by a coupling member according to this invention.

FIG. 5 shows adjacent two moving blades 1 of a steam turbine each having projections 4 and 5 on its inner and outer surfaces 2 and 3, respectively. The projection 4 is provided with a hemispherical recess 6 at the front end for receiving a corresponding hemispherical projection 7 formed at the front end of the projection 5 of the adjacent blade 1. The projection 7 and the recess 6 are engaged loosely and slidably with some clearance A as shown in FIG. 5.

The loose and slidable engagement of the projections 4 and 5 makes it possible to effectively absorb a force causing the turbine blades to vibrate during the operation thereof and prevent the deformation of the blades caused by the centrifugal force. Namely, the untwisting force acting in a direction shown by arrows a in FIG. 5 and caused by the centrifugal force of the blades 1 is absorbed by a so-called socket and ball coupling of the projections 4 and 5, and at the same time the vibration of the blades 1 is also absorbed by the slidable engagement of the hemicircular projection 7 and recess 6.

It should of course be noted that the arrangement of the hemispherical projection 7 and the recess 6 can be reversed.

As described above, the coupling device of this invention has a hemispherical projection and recess. Therefore, when a force acting in any direction is applied to the turbine blades during the operation thereof, the coupled portion would be slid thereby to absorb the force and increase the efficiency for attenuating the vibration of the blades.

In addition, since the coupling members are integrally formed with the moving blades, even when the blades were subjected to a force tending to deform them in the opposite directions, respectively, the coupled members would not be disengaged. Moreover, in a prior art, although a sleeve-type coupling member as shown in FIG. 4 is used, such coupling member requires much time and work for assembling. This problem can be solved by this simple structure of the coupling device of the turbine blades according to this invention.

What is claimed is:

1. A coupling device which couples adjacent turbine blades, said blades extending radially from a turbine wheel, said coupling device comprising opposing inner and outer blade surfaces;

a pair of projections integrally on opposing inner and outer blade surfaces, said projections extending from the blade surfaces circumferentially about the turbine wheel;

a hemispherical projection on one of said projections, a hemispherical recess on the opposing projection;

said hemispherical projection loosely engaging said hemispherical recess on the adjacent blade such that when said turbine wheel is at rest, there is some clearance between the hemispherical projection and the hemispherical recess of the adjacent blade.

* * * * *